US005655344A

United States Patent [19]

Moen et al.

[11] Patent Number: 5,655,344

[45] Date of Patent: Aug. 12, 1997

[54] FRAMEWORK OF PARTITION WALLS

[75] Inventors: Egil Moen, Kløfta; Arnfinn J. Strømmen; Knut Arnhjell, both of Oslo, all of Norway

[73] Assignee: Starka A/S, Oslo, Norway

[21] Appl. No.: 334,848

[22] PCT Filed: Nov. 3, 1991

[86] PCT No.: PCT/NO91/00136

§ 371 Date: Apr. 30, 1993

§ 102(e) Date: Apr. 30, 1993

[87] PCT Pub. No.: WO92/08014

PCT Pub. Date: May 14, 1992

Related U.S. Application Data

[63] Continuation of Ser. No. 50,429, Apr. 30, 1993, abandoned.

[30] Foreign Application Priority Data

Nov. 5, 1990 [NO] Norway ..... 90 4816

[51] Int. Cl.[6] ..... E04B 2/38

[52] U.S. Cl. ..... 52/238.1; 52/241; 52/481.1; 52/690; 52/731.5

[58] Field of Search ..... 52/239, 240, 241, 52/242, 238.1, 290, 481.1, 690, 731.5

[56] References Cited

U.S. PATENT DOCUMENTS

| | | | |
|---|---|---|---|
| 1,475,409 | 11/1923 | Riddle | 52/327 |
| 1,981,240 | 11/1934 | McNeil | 52/290 |
| 1,998,688 | 4/1935 | Robinson et al. | 52/241 |
| 2,000,243 | 5/1935 | Manske | 52/242 |
| 2,063,010 | 12/1936 | Balduf | 52/241 |
| 2,216,319 | 10/1940 | McGee | 52/243 |
| 2,256,394 | 9/1941 | Lamel . | |
| 3,293,813 | 12/1966 | Emmons . | |
| 3,897,668 | 8/1975 | McDonnell | 52/241 X |
| 3,908,328 | 9/1975 | Nelsson | 52/242 X |
| 4,443,991 | 4/1984 | Mieyal . | |
| 4,704,835 | 11/1987 | Jordan | 52/486 X |
| 4,787,767 | 11/1988 | Wendt | 52/241 X |
| 4,809,476 | 3/1989 | Satchell | 52/241 |
| 4,854,096 | 8/1989 | Smolik . | |

FOREIGN PATENT DOCUMENTS

| | | |
|---|---|---|
| 484084 | 6/1977 | Australia . |
| 1031131 | 5/1978 | Canada . |
| 2094320 | 2/1972 | France . |
| 2630145 | 10/1989 | France . |
| 2225832 | 12/1972 | Germany . |
| 2930973 | 2/1980 | Germany . |
| 2067639 | 7/1981 | United Kingdom . |

*Primary Examiner*—Wynn E. Wood
*Assistant Examiner*—Winnie Yip
*Attorney, Agent, or Firm*—Patterson & Keough, P.A.

[57] ABSTRACT

A framework for partitioning walls for rooms of houses, comprising in cross-section U-shaped floor, ceiling and wall profiles (1) which are designed to be fastened to the room's floor, ceiling and walls, together with upright profiles (15), the bottom (9) of the ceiling and floor profiles having an engagement section which projects from this, midway between the flanges (8), and which is designed to engage the respective end sections of uprights (15), thereby preventing movement of these perpendicular to the partitioning wall plane. According to the invention, the floor, ceiling and wall profiles (1, 2 and 3) are the same in cross-section, and the contact sections are composed of points or tongues (7) which are provided evenly spaced in the profiles' longitudinal direction. The uprights' (15) flanges (19) are designed to grip the pins and prevent mutual movement of the ceiling and floor profiles and the uprights in the ceiling and floor profiles' longitudinal direction during assembly of the wall.

6 Claims, 3 Drawing Sheets

FRAMEWORK OF PARTITION WALLS

This application is a continuation of U.S. Ser. No. 08/050,429 filed Apr. 30, 1993 now abandoned, which is a continuation of PCT International application Ser. No. PCT/NO91/00136 filed Nov. 4, 1991.

A framework for partitioning walls, especially modular walls, for rooms in houses, comprising floor, ceiling and wall profiles, which is designed to be fastened to the room's ceiling, floor and walls and support panel boards respectively, the profiles running on the plane of the partitioning wall, and upright profiles, hereinafter called uprights, designed to run vertically between the floor and ceiling profiles, where the profiles' cross section is principally U-shaped and comprises a bottom section, hereinafter called bottom, and two flange sections, hereinafter called flanges, and the bottom of the ceiling and floor profiles has a row of pegs or pins which are provided evenly spaced in the profiles' longitudinal direction and protrude from the bottom, midway between the flanges, and which are designed to engage the respective end sections of the uprights.

BACKGROUND OF THE INVENTION

From U.S. Pat. No. 4,704,835 there is a known framework of the above-mentioned type, comprising an upper and a lower horizontal profile and a row of vertical upright. Between the flanges of the horizontal profiles there projects inwards from the bottom a channel section which runs in the profile's longitudinal direction, and in the bottom of the end section of the uprights there is provided a slot which is designed to receive the respective channel sections. Thus the channel section only counteracts movement of the uprights in the horizontal profiles' transverse direction.

For mounting of the wallboards a number of hooks which are located along the vertical edge of the wallboards have to be connected to corresponding rows of holes in the uprights to ensure, amongst other things, accurate positioning of the uprights in relation to the wallboards. The hooks therefore have to fit the holes exactly. Thus the construction is expensive and complicated and the assembly work awkward.

It is not possible to place the uprights between the wallboards' vertical edges, since any uprights which are provided here are not secured and could fall. The mid section of the wallboards' could therefore bulge in or out, thus detracting from the appearance.

Furthermore, the horizontal profiles' channel sections abut against the respective end sections of the uprights. As each upright is composed of a single bar, it and thereby the wallboards, could be exposed to a buckling load in the event of any mutual movement of the floor and the ceiling.

The object of the invention is to provide a framework which is not encumbered with the above-mentioned disadvantages.

The framework according to the invention is characterized by the features in the claims presented.

In the following section the framework will be described in more detail with reference to the drawing which illustrates embodiments of a framework according to the invention.

DESCRIPTION OF THE PREFERRED EMBODIMENT(S)

Figure 1:
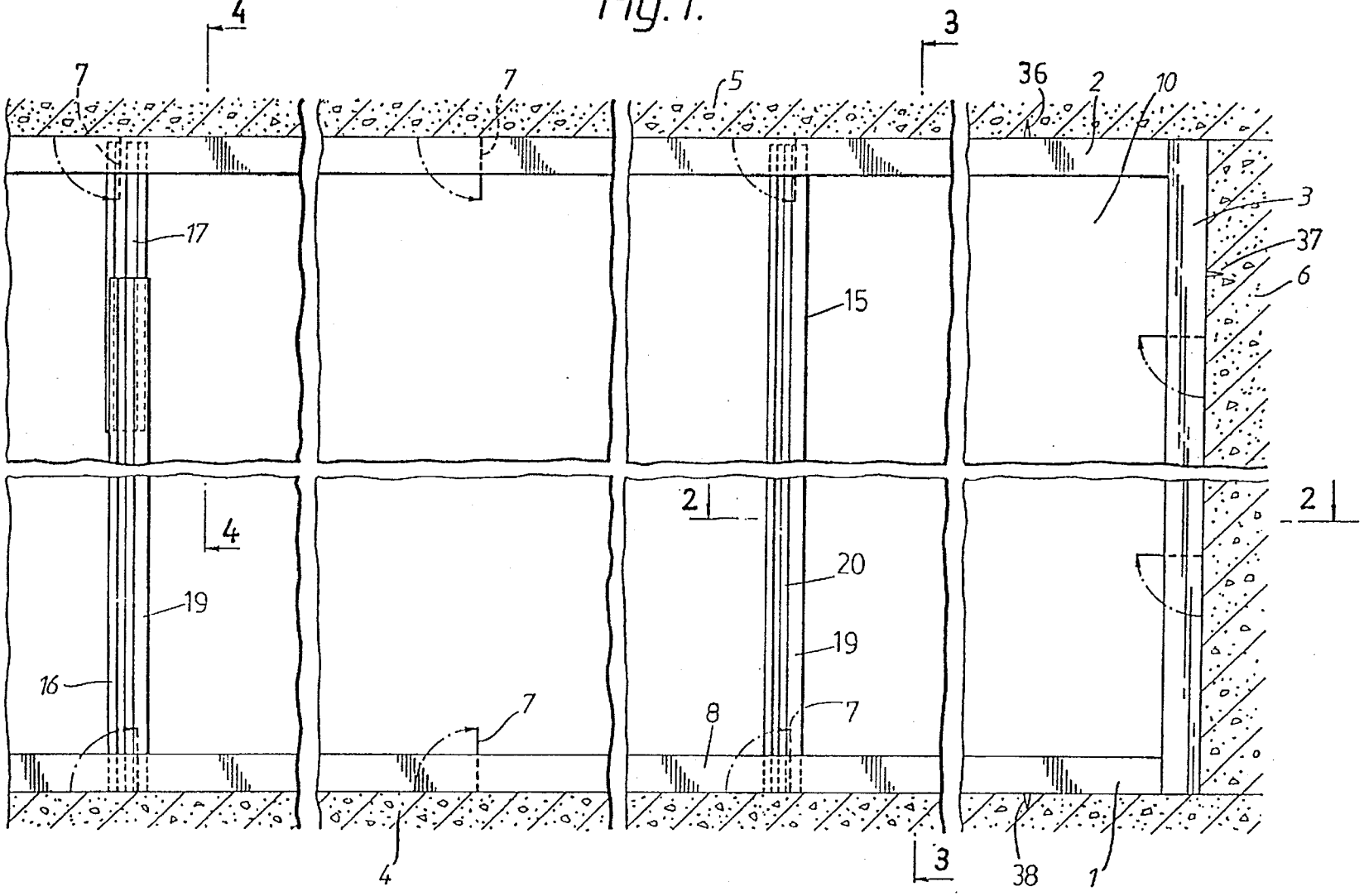
FIG. 1 is a side view of a first embodiment of a framework for a partitioning wall with panel boards not inserted, mounted between the ceiling, floor and a wall of a room in a house, on a slightly smaller scale than the scale of the other figures.
Figure 3:
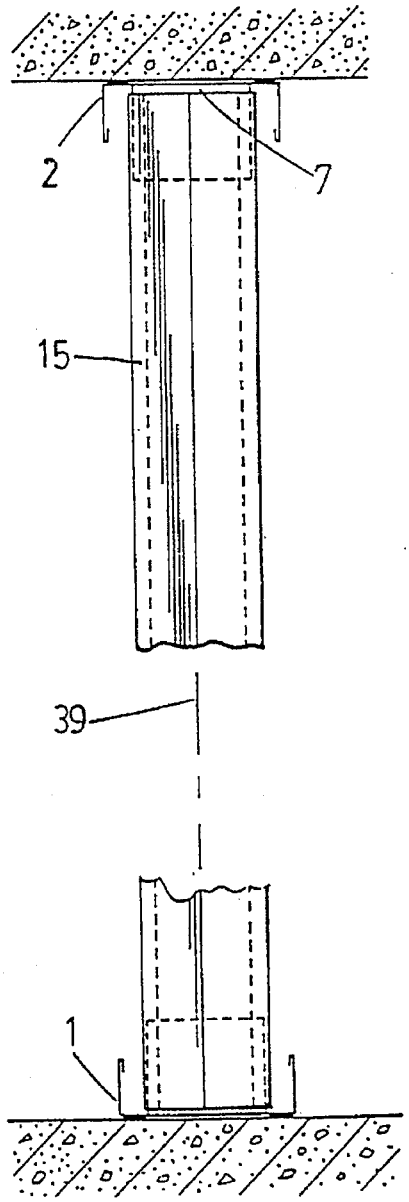
FIG. 3 is a section along the line 3—3 in FIG. 1.

As illustrated in FIG. 1 the framework comprises a lower profile or floor profile 1, an upper profile or ceiling profile 2 and a side profile or wall profile 3, which, e.g., by means of screws 38, 36, 37, can be fastened to the floor 4, ceiling 5 and a wall 6 respectively of the room, and which runs on the same vertical plane 39 (FIG. 3), i.e. the plane in which the partitioning wall runs. The profiles are U-shaped and equal in cross section and their openings face into the room.

Figure 2:
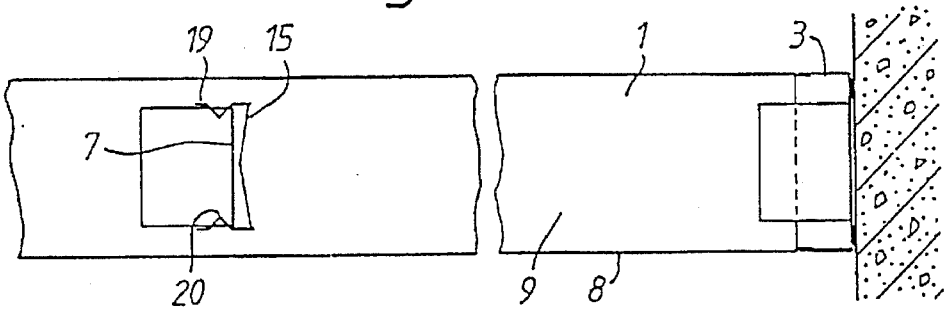
FIG. 2 is a section along the line 2—2 in FIG. 1.
Figure 4:
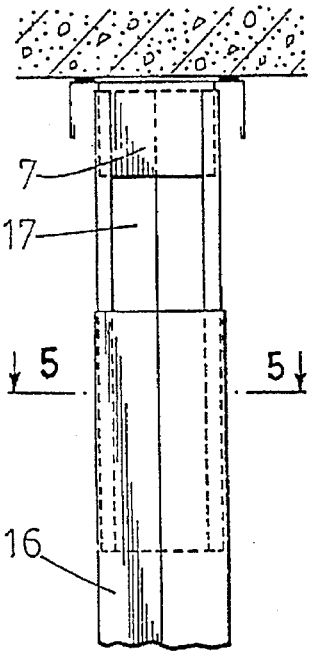
FIG. 4 is a section along the line 4—4 in FIG. 1.
Figure 6:
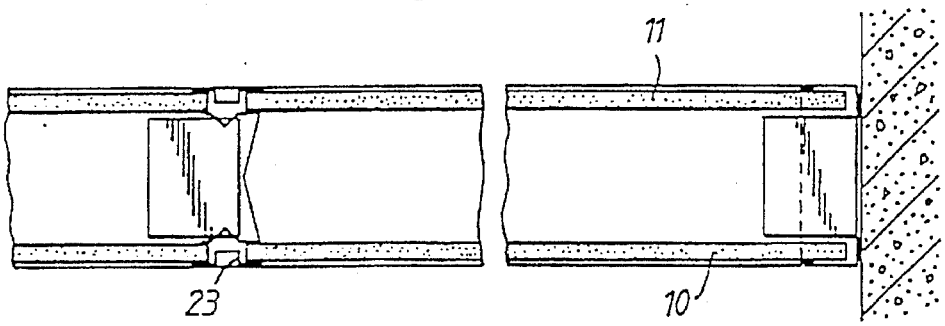
FIG. 6 is a section corresponding to that which is illustrated in FIG. 3 of a ready-assembled wall.
Figure 7:
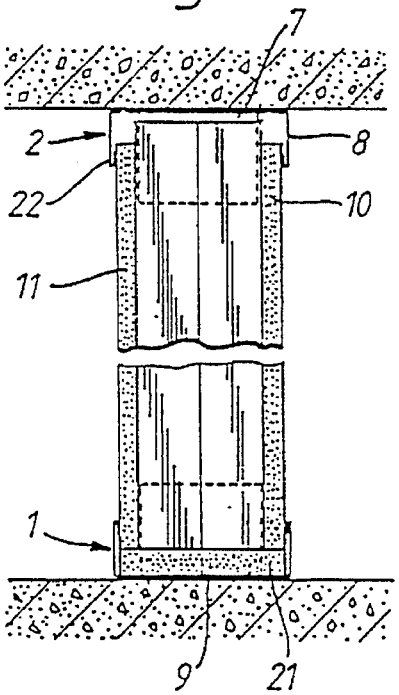
FIG. 7 is a section corresponding to that which is illustrated in FIG. 4 of a ready-assembled wall.

As is also illustrated by, e.g. FIG. 2, there is provided at equal intervals in the profiles' longitudinal direction and in their bottoms 9 a U-shaped kerf, whose legs face the same way in the longitudinal direction. The pegs, pins or tongues 7 thus formed are bent in between the profiles' flanges 8, so that they run vertically on these and the profile's bottom 9. The width of the tongues is principally so much smaller than the distance between the profile's flanges 8 that on each side of this between the flanges 8 and the tongue 7 there can be fitted a wallboard 10, 11, as is better illustrated in FIGS. 6 and 7.

The framework further comprises vertically running uprights 15, 16 and 17 which are provided between the ceiling and floor profiles. These too are substantially U-shaped in cross section. According to a first embodiment of an upright the inside width of the upright's bottom 18 is slightly larger than the width of the tongues 7, and the upright's flanges 19 have back or bead sections 20 opposite each other which are designed to, grip around around the tongues when these are inserted into associated end sections of the upright with the tongues extending against beside and principally parallel to the bottom 18, thus preventing mutual movement of the tongues 7 and the upright in the ceiling or floor profile's longitudinal direction when the upright and ceiling and floor profiles are assembled in this manner.

Figure 5:
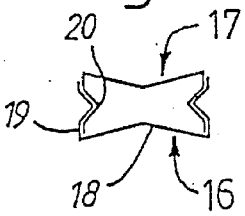
FIG. 5 is a section along the line 5—5 in FIG. 4.

The upright may be constructed of a relatively thin plate material and e.g. of metal or plastic, thus permitting the flanges 19 to bend elastically to some extent relative to the bottom 18. This makes it possible to assemble an upright of two frame profiles which run in parallel with their openings facing each other, thus permitting them to be pushed telescopically into each other as illustrated in FIG. 5. This allows the upright to be used later for walls of lesser or greater height than the original, and during the first assembly of a wall it is not necessary to cut the upright pieces with great accuracy, which makes assembly simpler and faster, since it is a simple matter to shorten or extend the upright by telescopic mutual movement of the pieces.

In order to ensure that such telescopic uprights with pieces situated above one another run vertically when the uprights' end sections are fastened to pairs of tongues of the ceiling and floor profiles, these profiles must be located in such a way that one tongue 7 of a pair of tongues is slightly displaced in relation to the vertical line through the other tongue, as illustrated in the left-hand section of FIG. 1.

If each upright is composed of a single profile, the profiles are arranged in such a way that the tongues of the pairs of tongues lie on the same vertical line, as illustrated in the right-hand section of FIG. 1.

If, when the uprights are assembled, there is a clearance between their end sections and the bottom of the adjacent ceiling or floor profiles, and the uprights are not firmly connected to the tongues, the uprights will be able to move in relation to the tongues, thus permitting mutual movement of the ceiling and the floor.

Alternatively, in the case of the last-mentioned aligned arrangement of the pairs of tongues, uprights can be provided comprising an upper and a lower profile element whose openings face the same way, together with a relatively short central profile element whose opening faces the opposite way, an end section of the upper and lower profile element thereby being telescopically inserted into the respective end sections of the central profile element.

A wallboard 10, 11 whose width may be a multiple of the distance between neighbouring tongues and whose height is slightly less than the distance between the floor profile's bottom and the lower end 22 of the flanges 8 and the ceiling profile 2, can be mounted by holding it slightly on a slant and first inserting it into the ceiling profile between its tongues 7 and one of its flanges 8, whereupon it is swivelled until it is aligned vertically and its lower edge is situated immediately above the space between the tongues and a flange of the floor profile, and thereafter it is lowered until it abuts against a bottom strip or block 21 which has been inserted in the floor profile in advance, and which is high enough to ensure that the upper edge of the wallboard cannot be swung outwards past the lower edge 22 of the ceiling profile.

If the wallboard has to constitute an end board of the partitioning wall and project from a house wall, it is finally pushed in the floor and ceiling profiles' longitudinal direction until one of its vertical edges is situated between the wall profile's tongues and one flange.

If the wallboard's height is slightly greater than the distance between the floor profile's bottom and the lower edge 22 of the ceiling profile's flanges 8, but less than the distance between these profiles' bottoms, the wallboard can be mounted without the use of the block 21, the wallboard being first brought into abutment against the bottom of the floor profile and then bent to such an extent that the distance between its horizontally running edges becomes so small that the upper edge of the wallboard can pass the above-mentioned edge 22, whereupon the wallboard is straightened out.

After installation of the wallboards, their edge sections and possibly sections between the edge sections can, e.g., be screwed to the flanges of the uprights and the floor, ceiling and wall profiles.

A known per se hat profile 23 can finally be mounted whereby it is fastened to the wallboards, e.g. by means of screws, in order to seal the joint between two wallboards.

Figure 8:
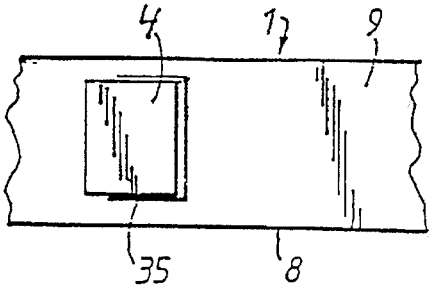
FIG. 8 is a section corresponding to that which is illustrated in FIG. 2 of another embodiment of an upright.

FIG. 8 illustrates a second embodiment of an upright 35. This too is U-shaped in cross section, but the flanges are substantially level and run in parallel, or possible slightly towards each other in the direction away from the bottom.

When the tongues of the ceiling and floor profiles are inserted into the respective end sections of such uprights, the flanges of the uprights will abut elastically against the side edges of the tongues. In this case the frictional forces will be sufficient to counteract mutual movement of the tongues and the upright, both when attempts are made to move the uprights in the ceiling or floor profile's longitudinal direction and perpendicular to this, thus allowing the wallboards to be installed without the risk of displacement of the uprights.

After installation of the wallboards, sections of these, as mentioned above, are fastened to the uprights by means of, e.g., screws, which prevents any movement whatsoever of the uprights in the floor and ceiling profiles' longitudinal direction.

If there is a clearance between the wallboards and the bottom of the ceiling profile, the wallboards will not prevent a mutual vertical movement of the ceiling and the floor, thus preventing the partitioning wall from being exposed to a destructive buckling load.

It is possible to produce the floor, ceiling and wall profiles of a bottom piece and two flange pieces, the side pieces, e.g. along one longitudinal edge, having a slot whose width approximately corresponding to the thickness of the bottom piece. Each longitudinal edge of the bottom edge can be pressed into the slots of the respective flange pieces and secured there by means of mutual force fit, snap fasteners, glue or the like.

Furthermore, the bottom of the floor, ceiling and wall profiles can be constructed without tongues, a rail with such tongues or pins being releasably attached between the flanges and to the bottom. After the profiles have been attached, the rails can be connected to them. This arrangement facilitates accurate positioning of the tongues and a possible subsequent alteration of the wall, e.g. insertion of doors, windows, etc.

Thus the framework of the above-described partitioning wall comprises only one profile type which is used for attaching the wall to the room's floor, ceiling and walls, and only one profile type which is used for the wall's uprights, since these uprights can be telescopically connected. Thus the production and assembly of the partitioning wall is extremely simple and cheap.

We claim:

1. A framework for modular partitioning walls, especially modular walls, for a room of a house, the room having a ceiling, floor and walls, comprising:

floor, ceiling and wall profiles adapted for fastening to the room ceiling floor and walls in an orientation defining the plane of the partitioning wall, each of the floor, ceiling and wall profiles including a base section, and two flange sections to present a principally U-shaped cross section, said floor and ceiling profiles having similar cross sections with each including a plurality of tongue elements protruding from their respective base section, said tongue elements being positioned between the flanges of their respective ceiling and floor profiles, opposite vertical edges of said tongue elements defining a width of said tongue elements;

panel boards presenting opposed vertical surfaces defining a panel board thickness; and upright profiles adapted to run vertically between the floor and ceiling profiles, each of the upright profiles including a base section, and two flange sections to present a principally U-shaped cross section, the respective end sections of the upright profiles being adapted for elastic, telescopic engagement of said tongue elements, the flanges of said upright profiles being generally resilient and spaced apart by a distance just smaller than the width of said tongue elements whereby the ends of said upright profiles are adapted to each resiliently grip a single respective tongue element protruding from the base of the appropriate ceiling and floor profile in a telescoping fit, said tongue elements of said floor and ceiling profiles respectively being generally oriented in a single row and said base sections of said ceiling and floor profiles being clear of protrusions other than said tongue elements such that the end of a respective upright profile is engageable with a desired tongue element upon horizontal motion of said end of said upright profile relative to said desired fixed tongue element, and each vertical edge of said tongue elements being spaced apart a slightly greater distance from the respective flanges of the floor and ceiling profiles than the thickness of the panel boards whereby said end edge sections of said panel boards are received between the upright profiles and the respective flanges of floor and ceiling profiles for abuttable, retaining engagement of the opposed vertical surfaces of said panel boards by said floor and ceiling profile flanges and said upright profiles.

2. The invention as claimed in claim 1, each of said tongue elements defining a generally upright plate plane.

3. The invention as claimed in claim 2, said tongue elements each comprising a piece partially cut from the base section of a respective profile, said piece being bent upwardly to present said generally upright plate plane.

4. The invention as claimed in claim 2, said tongue elements each comprising a plate with a right angle bend having first and second orthogonally oriented legs, one leg of said bend being fixedly coupled to the base section of a respective profile.

5. The invention as claimed in claims 1, 2, 3, or 4 each of the upright profile flanges having respective beads projecting inwardly toward each other whereby said tongue elements are engageable between the base section and said beads of a respective upright profile.

6. The invention as claimed in claim 5, each of said upright profiles comprising two uprights pieces with the same cross section oriented such that the cross section openings face each other, and are telescopically received into each other.

* * * * *